US005078733A

United States Patent [19]

Eveleigh et al.

[11] Patent Number: 5,078,733

[45] Date of Patent: Jan. 7, 1992

[54] PACIFIER FOR PREMATURE NEWBORNS

[76] Inventors: Robert B. Eveleigh, P.O. Box 44627, Indianapolis, Ind. 46204; Shereen D. Farber, 4410 N. Pennsylvania St., Indianapolis, Ind. 46205

[21] Appl. No.: 507,872

[22] Filed: Apr. 12, 1990

[51] Int. Cl.[5] ..... A61J 17/00

[52] U.S. Cl. ..... 606/236; 606/234; 215/11.1

[58] Field of Search ..... 604/77; 215/11.1, 11.2, 215/11.3, 11.4, 11.5, 11.6; 606/234, 235, 236; D24/45–48

[56] References Cited

U.S. PATENT DOCUMENTS

| | | | |
|---|---|---|---|
| D. 262,575 | 1/1982 | Araujo, Jr. . | |
| D. 262,576 | 1/1982 | Anderson-Shanklin et al. | D21/46 |
| D. 271,798 | 12/1983 | Araujo, Jr. | D24/46 |
| D. 285,839 | 9/1986 | Roehrig | D24/45 |
| D. 312,312 | 11/1990 | Herritz | D24/45 |
| 2,366,214 | 1/1945 | Ramaker | 128/252 |
| 2,816,547 | 12/1957 | Adisman . | |
| 3,130,725 | 4/1964 | Griesinger | 128/252 |
| 3,610,248 | 10/1971 | Davidson | 128/360 |
| 3,669,112 | 6/1972 | Mager et al. | 128/252 |
| 3,892,243 | 7/1975 | Bell | 128/359 |
| 3,924,621 | 12/1975 | Cassimally | 128/252 |
| 4,078,570 | 3/1978 | Frodrich et al. | 128/359 |
| 4,192,307 | 3/1980 | Baer | 128/252 |
| 4,321,927 | 3/1982 | Lynch | 128/360 |
| 4,381,785 | 5/1983 | Robbins | 128/359 |
| 4,403,613 | 9/1983 | Panicci | 128/360 |
| 4,481,949 | 11/1984 | Kesselring et al. | 128/360 |
| 4,545,378 | 10/1985 | Chrones | 128/360 |
| 4,586,621 | 5/1986 | Dahan | 215/11 R |
| 4,632,263 | 12/1986 | Gertzman | 215/11 R |
| 4,909,253 | 3/1990 | Cook et al. | 606/234 |

FOREIGN PATENT DOCUMENTS

| | | | |
|---|---|---|---|
| 8603402 | 6/1986 | World Int. Prop. O. | 606/234 |

OTHER PUBLICATIONS

Bernbaum, Judy Co. MD, Gilberto R. Pereira, MD, John B. Watkins, MD, and George J. Peckman MD, "Nonnutritive Sucking During Gavage Feeding Enhances Growth & Maturation in Premature Infants", *Pediatrics*, vol. 71, No. 1, Jan. 1983.

Measel, Carol Porter RN, MSN and Gene Anderson, RN, PhD, FAAN, "Nonnutritive Sucking During Tube Feedings: Effect on Clinical Course in Premature Infants", Journal of the Nurses Assoc. of the American College of Obstetricians and Gynecologists, vol. 8, No. 5, Sep./Oct. 1979.

Mehes, K., "Normal Values for Philtral Length, Oral Intercommissural Distance and Sternal Length in Newborn Infants", Journal of Craniofacial Genetics and Development Biology, 1:213–216 (1981).

"Pacifiers: Are They Safe"? A Report by the Consumer Affairs Committee of the Americans for Democratic Action, Producers of the Annual Toy Quality Report, Mar. 8.

Rogers, Richard, Hitoshi Kita, Larry Butcher and Donald Novin, "Afferent Projections to the Dorsal Motor Nucleus of the Vagus", *Brain Research Bulletin*, vol. 5, pp. 365–373.

Sivan, Yakov, Paul Merlob and Salomon M. Reisner, "Philtrum Length and Intercommissural Distance in Newborn infants", Journal of Medical Genetics, 1983, 20, 130–131.

*Primary Examiner*—Stephen C. Pellegrino
*Assistant Examiner*—Glenn Dawson
*Attorney, Agent, or Firm*—Woodard, Emhardt, Naughton, Moriarty & McNett

[57] ABSTRACT

A pacifier for a premature or small full-term infant includes a mouth shell and a nipple projecting generally perpendicularly therefrom. The mouth shell includes a perioral surface that is concave to conform to the perioral region of the infant and is adapted to exert a substantially uniform pressure around the mouth of the infant. The perioral surface includes a plurality of nubs projecting away from the surface for contact with and stimulation of the perioral region of the infant. The mouth shell includes a flared annular surface surrounding the perioral surface to make the pacifier large enough to avoid ingestion by the newborn, while providing clearance between the mouth shell and the infant's facial features. A V-shaped notch in the annular surface is included to accommodate nasogastric tubes in the infant's nose.

The nipple has a generally constant cross-section along its entire length. The upper, or dorsal, surface of the nipple is domed or curved to contact the hard palate of the infant to stimulate the sucking relex without causing hypersensitivity. The lower, or ventral, surface of the nipple is flat to contact the surface of the tongue to, likewise, stimulate the sucking response without causing hypersensitivity. The nipple can be hollow with sufficient rigidity to provide a uniform pressure against the hard palate and tongue of the infant during sucking. The pacifier can be of a one-piece construction composed of a medical grade silicone plastic material.

16 Claims, 1 Drawing Sheet

PACIFIER FOR PREMATURE NEWBORNS

BACKGROUND OF THE INVENTION

This invention relates to a pacifier for undersized newborn babies and, in particular, for premature or undersized newborns having a birthweight under approximately five pounds.

Several pacifiers in the prior art are designed for use by full-term newborn babies, or newborns that are of normal size having a birthweight of over five pounds. To our knowledge, there has been no pacifier as yet that is specifically sized and shaped to meet the needs of the premature or small full-term infant. Pacifiers of the prior art for newborns, such as that described in U.S. Pat. No. 4,321,927, have been concerned primarily with providing a pacifier having a safety shield or mouth shell that prevents the baby from swallowing the pacifier, while preventing the safety shield from blocking the nasal passages of the newborn.

Babies born early frequently do not have fully developed or coordinated sucking and swallowing reflexes, particularly newborns of 32 to 35 weeks gestation. In addition, some premature newborns, and small full-term babies (under approximately five pounds in birth weight), may have a much smaller intraoral cavity than the average full-term baby. Since premature infants may have underdeveloped intraoral cavities and may demonstrate incoordinate sucking patterns, use of conventional nipples and pacifiers are inappropriate to facilitate improvement in sucking responses in these infants. Babies with poorly coordinated sucking abilities are at risk during oral feeding of regurgitating and aspirating the formula. Moreover, this poor coordination and weakness in sucking frequently means that the newborn will be unable to obtain the amount of formula needed for normal growth, without expending excessive energy in sucking.

Premature or small infants often require gavage feedings in order to obtain proper nourishment. Non-nutritive sucking opportunities available for babies fed through nasogastric (NG) tubes are generally inadequate and unsafe, which retards the development of normal, healthy sucking capabilities. Frequently, therapists or nurses work with NG tube babies using their fingers as a sucking stimulus. Premature infants unable to suck during gavage feeding often do not associate sucking with nourishment, which further retards the newborn's transition to oral feeding. To our knowledge, no commercially available pacifier is adapted for use according to recommended standards in conjunction with nasogastric tubes.

Research has demonstrated that pacifier use during nasogastric feedings in premature infants accelerates the maturation of the sucking reflex. See, e.g., Bernbaum, Pereira, Watkins and Peckham, "Nonnutritive Sucking During Gavage Feeding Enhances Growth and Maturation in Premature Infants", Pediatrics, pp. 41–45, Vol. 71, No. 1, 1983, and Measel and Anderson, "Nonnutritive Sucking During Tube Feedings: Effect on Clinical Course in Premature Infants", JOGN Nursing, pp. 265–272, Sept./Oct. 1979, both references of which are incorporated herein by reference.

Standard sized nipples or pacifiers have been found to be too large for the premature newborn, causing the infant to gag or to push the nipple out. One method of overcoming this problem has been to use the bulb end of a typical disposable medicine dropper as a nipple substitute. However, the medicine dropper bulb is not designed specifically for an infant's intraoral cavity. To our knowledge, no prior art pacifier is available that is directly compatible with the small intraoral cavity of a premature or small newborn and that is sized and shaped to stimulate the sucking response of the baby without irritating or sensitizing the infant's perioral or intraoral regions.

Under normal circumstances, a baby's tongue puts pressure on the roof of the mouth and on the palatal arches during normal sucking. But when a normal sucking response has not yet developed, such as in undersized babies, the tongue surface, palate, or arches may become hypersensitive because they have never received adequate pressure from the infant's tongue. This hypersensitivity may produce an increased gag reflex. On the other hand, in NG tube babies, the NG tube is constantly pressing on the back of the soft palate, which can result in a reduced gag reflex. In either case, it is critical that the nipple of the pacifier be sized and shaped to fill the oral cavity appropriately without undue pressure in some regions and inadequate pressure in others.

A pacifier, such as that sold under the tradename "NUK", is presently available for normal sized babies that has a bulbous nipple with a flattened surface, such as is illustrated in the patent to Frodrich et al., U.S. Pat. No. 4,078,570. The flattened surface on the "NUK" nipple is oriented at an acute angle to the axis of the nipple and is, therefore, adapted for use by a baby with a normal degree of developmental sucking ability. Normal newborns elevate the back of their tongue as they swallow after a suck. Some premature infants with weak, incoordinate sucks have not yet developed the ability to elevate the tongue in the posterior dorsal tongue surface. While standard pacifiers generate pressure on the dorsal tongue surface of a normal infant during sucking, these pacifiers fail to provide the same pressure and stimulus for some special newborns.

It is known that a natural, physiological stimulus that is designed to simulate the perioral pressure experienced by a baby during breast feeding can enhance the feeding response. See, e.g., Rogers RC et al., "Afferent Projections to the Dorsal Motor Nucleus of the Vagus", Brain Research Bulletin 5:365–373, 1980. Perioral pressure stimulates pressure receptors located in the skin around the infant's mouth. Upon stimulation, these receptors send signals to the brain, resulting in an activation of the parasympathetic division of the autonomic nervous system. The parasympathetic division functions to restore energy to the baby, such as during feeding and sleeping.

Accordingly, it is an object of the present invention to provide a pacifier for premature or small newborn infants. Another object is to provide a pacifier that will enhance the sucking response of the newborn while preventing the development of hypersensitivity in the perioral and intraoral regions of the infant. Further objects and advantages of the present invention will be more clearly demonstrated in the following description of the invention and accompanying figures.

SUMMARY OF THE INVENTION

In accordance with the present invention, a pacifier for a premature infant includes a mouth shell having an inner perioral surface for contact with the perioral region of the infant, and a nipple projecting generally perpendicularly from the perioral surface toward the infant's mouth when the pacifier is in place. The nipple can be hollow, and has a substantially constant cross-section along its entire length, with a curved upper surface adapted to contact the hard palate of the premature infant and a flat lower surface opposite the upper surface adapted to contact the tongue of the premature infant. The tip of the nipple can include an angled surface to contact the infant's tongue during swallowing.

The perioral surface of the mouth shell is substantially concave towards the perioral region, thereby applying constant and natural pressure around the perioral region when the pacifier is in place. The perioral surface can include a plurality of outwardly projecting nubs to provide further stimulation to the perioral region of the newborn infant.

In another feature of the invention, the mouth shell includes a flared annular surface surrounding the perioral surface. The flared annular surface is included to make the pacifier large enough that it cannot be ingested by the newborn, and is flared away from the newborn's face to provide clearance between the shell and facial features. The flared annular surface can also include a V-shaped notch to provide clearance for the nose of the premature infant. The notch is also adapted to receive a nasogastric tube therethrough when the pacifier is in place in the infant's mouth and the nasogastric tube is in position in the newborn's nose.

Each of the several features of this novel pacifier for premature infants are adapted for forming in a one piece unitary construction. The pacifier may be molded from a resilient material such as silicone plastic.

DESCRIPTION OF THE PREFERRED EMBODIMENT

Figure 3:
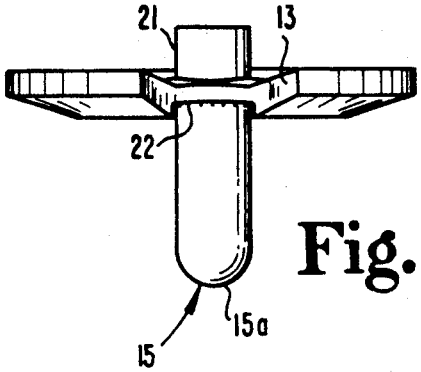
FIG. 3 is a top view of the pacifier shown in FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
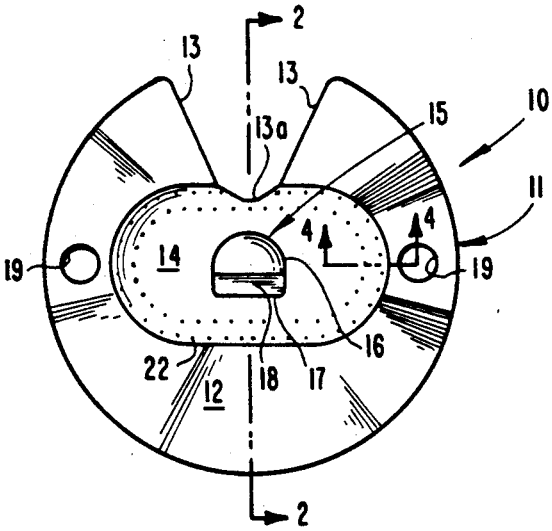
FIG. 1 is a frontal view of the preferred embodiment of the pacifier of the present invention, showing the nipple and surface of the mouth shell adjacent the premature newborn's face.
Figure 2:
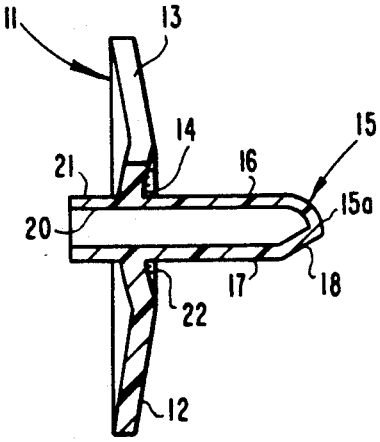
FIG. 2 is a side cross-sectional view of the pacifier shown in FIG. 1 taken at line 2—2 as viewed in the direction of the arrows.

Referring to FIGS. 1-3, the preferred embodiment of pacifier 10 comprises a mouth shell 11 and a nipple 15 projecting generally perpendicularly from the mouth shell 11. The mouth shell 11 includes an inner perioral surface 14 that is curved as illustrated in FIGS. 2 and 3 so that the perioral surface 14 can encompass the perioral region of the newborn when the pacifier 10 is in the newborn's mouth. The perioral surface 14 is sized to provide for a sufficient region of contact around the mouth of the premature infant to protect the mouth and provide adequate stimulation for the perioral region. While the newborn is sucking on the pacifier 10, the perioral surface 14 presses against the perioral region of the infant as the nipple 15 is pulled into the infant's mouth by the sucking action. This pressure exerted on the perioral region by the perioral surface is effective in calming the infant and enhancing the sucking response. Thus, in the preferred embodiment of pacifier 10, the perioral surface 14 is made as large as possible to increase the area of pressure on the perioral region, while keeping clear of the infant's nose so as not to impede breathing. For premature infants, the mouth shell 11 can measure approximately 1.34 inches in width and 0.78 inches in height. The perioral surface 14 can be sized to accommodate even smaller perioral regions.

In the preferred embodiment, mouth shell 11 is formed of a deformable material, such as a clear, resilient, medical grade plastic. The mouth shell material may be a bubbled silicon plastic. This material is deformable under pressure so that as the perioral surface 14 of the mouth shell is pressed against the infant's perioral region due to the sucking action, the perioral surface 14 will compress and deform slightly to maintain an even area of contact around the infant's mouth. Thus, unlike prior art pacifiers in which the mouth shell is formed of a rigid plastic, the perioral surface 14 of the present invention will deform, rather than remain stiff, which eliminates the problem caused by stiff mouth shells of uneven and uncomfortable pressure around the newborn's mouth. However, it is important that the mouth shell have sufficient rigidity, provided by the combination of the material properties and the curvature of the shell, to prevent the pacifier from buckling and slipping into the infant's mouth during sucking. The use of a medical grade resilient plastic for the mouth shell material insures that the pacifier 10 will not irritate the perioral region or otherwise cause discomfort to the newborn infant. A clear plastic mouth shell also allows medical supervisory personnel to monitor the infant's sucking activity.

The mouth shell 11 includes a flared annular surface 12 surrounding the perioral surface 14. The flared annular surface 12 is included to make the pacifier large enough to avoid ingestion by the infant. The annular surface 12 is flared away from the infant to provide clearance between the mouth shell 11 and facial features of the newborn, such as the chin. The flare of the annular surface, in the fashion of a frusto-conical surface, also provides additional rigidity to the mouth shell 11 to keep the pacifier from buckling during sucking. The flared annular surface 12 may also include a number of openings 19 through the mouth shell, to provide an air passageway in the event that the pacifier is ingested by an older child.

In the preferred embodiment of the present invention, a V-shaped notch 13 is provided at the upper edge of the annular surface 12. The notch 13 is provided to allow clearance for the infant's nose when the pacifier is in place in the in newborn's mouth. The notch 13 is also sized to accommodate nasogastric (NG) tubes, since premature infants frequently require gavage feeding. Prior art pacifiers do not provide means to accommodate these tubes while allowing the infant the comfort and benefit of a pacifier. Thus, the nasogastric tubes may be inserted through the V-shaped notch 13 and into the infant's nose without interfering with the operation of the tubes or the pacifier.

In the preferred embodiment, the V-shaped notch 13 includes a fillet 13*a* cut into the perioral surface 14 of the mouth shell. The orientation of the nipple 15 relative to the fillet 13*a* ensures that the pacifier 10 can only be inserted one way into the infant's mouth, that is to provide clearance for the newborn's nose. Otherwise, the nipple 15 may not be fully inserted into the infant's mouth, thereby frustrating the development of the sucking reflex.

The nipple 15 in the present embodiment is sized and shaped to fit the small intraoral space of premature newborns. The nipple 15 includes a dorsal surface 16 that has a domed shape along the entire length of the nipple. The nipple 15 also includes a ventral surface 17, opposite the dorsal surface 16, that is flat throughout the length of the nipple. The domed shape of the dorsal surface 16 will cause the dorsal surface to press up against the hard palate of the infant during sucking. Pressure on the palate not only assists in the development of the hard palate of the newborn, but it also helps prevent intraoral hypersensitivity which may retard the sucking reflex and delay the transition to oral feeding. The flat ventral surface 17 will rest on the tongue surface and is designed to further enhance the sucking response of the infant by the constant pressure on the tongue. The flat ventral surface 17 also helps prevent the development of hypersensitivity in the tongue, thereby enhancing the sucking reflex.

The nipple 15 is substantially constant in its cross-section throughout the length of the nipple, as shown in FIG. 2. In the preferred embodiment, the domed dorsal surface 16 has a height and width of about 0.314 inches and the nipple 15 has a length of about 0.866 inches from the perioral surface 14. For newborn's having smaller intraoral features, the dimensions of the nipple can be reduced to optimize the stimulus to the newborn's sucking response.

The length of the nipple is adapted to avoid contacting the soft palate hen the pacifier is in the infant's mouth, since such contact can stimulate the gag reflex causing the baby to reject the pacifier. In addition, the tip 15*a* of the nipple can include an angled section 18, angled upward from the ventral surface 17 to provide more clearance from the soft palate. The angled section 18 of the tip 15*a* also provides a reaction surface for the newborn's tongue during swallowing.

The entire pacifier 10 is of one piece construction and can be composed of a non-toxic medical grade silicone plastic. The nipple 15 has some resilience to allow the premature infant the ability to move his tongue in an isotonic contraction (i.e., a muscle contraction with a shortening of the length of the tongue muscles), rather than an isometric contraction (i.e., a contraction without a shortening of the length of the tongue muscles). On the other hand, the nipple has adequate rigidity to avoid undue compression during sucking in order to generate pressure against the hard palate and the tongue of the newborn in the manner and for the reasons described above. The mouth shell may have a plurality of voids in the silicon material, formed in a suitable molding process, to increase the flexibility of the shell.

In the preferred embodiment, the nipple 15 is hollow with a cavity 20 extending throughout the entire length of the nipple. To facilitate producing the pacifier 10, such as in a die casting operation, the nipple includes a nipple stem 21 extending outward from the mouth shell 11. The nipple stem 21 also provides a grip for medical personnel to remove or insert the pacifier into the newborn's mouth.

Figure 4:
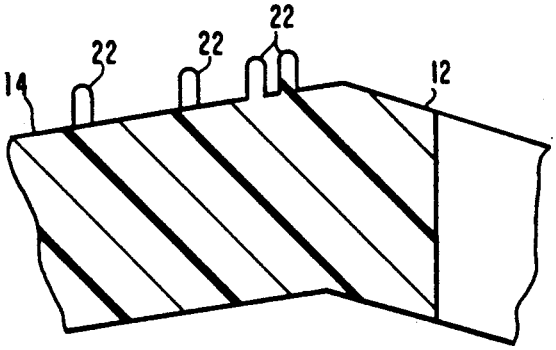
FIG. 4 is an enlarged cross-sectional view of a portion of the perioral surface of the pacifier, taken along line 4—4 as shown in FIG. 1 and as viewed in the direction of the arrows.

In another feature of the preferred embodiment, the perioral surface 14 includes a plurality of nubs 22, projecting away from the perioral surface toward the perioral region of the infant, as shown in the detail view of FIG. 4. The nubs 22 are resilient and are intended to bend or buckle under compression between the perioral surface and the infant's perioral region during sucking. In the preferred embodiment, the nubs project about 0.025 inches from the perioral surface 14. The nubs 22 provide additional stimulation to the perioral region of the newborn to further enhance the infant's sucking response and to stimulate parasympathetic pressure receptors located in the skin around the infant's mouth.

In the preferred embodiment, the nubs 22 are shown in a pattern around the perimeter of the perioral surface 14. The nubs are located to avoid contact with the newborn's lips. The nubs 22 may be replaced with resilient ribs or other forms of projections from the perioral surface, provided the projections have sufficient flexibility and resilience to flex or buckle during sucking. If the projections are too rigid, the perioral region of the infant can become irritated and the sucking response inhibited.

The shape and size of the pacifier 10 has been specifically adapted for use by premature babies of 33–40 weeks gestation, or for small full-term infants of about 5 pounds or less. The intraoral region of a premature or small infant may be too small to accommodate the pacifiers of the prior art. Consequently, the pacifier 10 of the present invention provides a mouth shell and nipple construction that will be comfortable and non-aversive for use by the special newborn, prevent hypersensitivity of the perioral and intraoral regions of the newborn, and enhance the sucking response of the infant. As a further stimulus to the newborn, the pacifier 10 can be flavored or scented to encourage the infant to retain the pacifier and to stimulate the sucking reflex. An olfactory stimulation kit can be provided with the pacifier so that medical personnel may dip the pacifier into a vanilla or banana flavoring. These odors have been demonstrated to produce reflex sucking responses in newborns.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pacifier for a premature infant, comprising:

a mouth shell having a perioral surface for contact with the perioral region of the infant; and a nipple projecting generally perpendicularly from said perioral surface toward the infant's mouth when the pacifier is in place, said nipple having a substantially constant cross-section along its entire length with a curved upper surface adapted to contact the hard palate of the premature infant and a flat lower surface opposite said upper surface adapted to contact the tongue of the premature infant.

2. The pacifier for a premature infant according to claim 1, wherein:

said perioral surface is substantially concave to conform to the perioral region when the pacifier is in place; and said mouth shell is composed of a resiliently flexible material so that when said perioral surface is contacting the perioral region of the infant, said perioral surface produces a pressure uniformly over the perioral region when the infant is sucking on the nipple.

3. The pacifier for a premature infant according to claim 2, wherein said pacifier is of one piece construction.

4. The pacifier according to claim 3, wherein at least a portion of said nipple is coated with a flavoring adapted to stimulate the sucking reflex of the infant.

5. The pacifier for a premature infant according to claim 3, wherein said pacifier is composed of a silicone plastic material, with said mouth shell including a plurality of voids in said material.

6. The pacifier for a premature infant according to claim 1, further comprising:

a tip integral with said nipple distal said perioral surface, said tip having an angled flat surface adjacent said lower surface of said nipple and forming an obtuse angle with said lower surface.

7. The pacifier for a premature infant according to claim 6, wherein:

said pacifier is of one piece construction;

said nipple includes a first end distal said tip and a cavity opening from said first end along the longitudinal length of said nipple; and said nipple is composed of a resilient material having sufficient rigidity to generate a uniform pressure against the hard palate and tongue of the infant during sucking.

8. The pacifier for a premature infant according to claim 1, wherein:

said perioral surface includes a plurality of flexible and resilient projections extending therefrom for contact with the perioral region of the infant.

9. The pacifier for a premature infant according to claim 8, wherein:

said plurality of projections includes a pattern of nubs arranged around the perimeter of said perioral surface.

10. The pacifier for a premature infant according to claim 8, wherein said perioral surface is substantially concave to conform to the perioral region of the premature infant when the pacifier is in place.

11. The pacifier for a premature infant according to claim 1, wherein:

said mouth shell includes a flared annular surface surrounding said perioral surface, said flared annular surface extending at an angle away from the face of the infant when the pacifier is in place in the infant's mouth, said flared annular surface further having an outer dimension larger than the premature infant's mouth to prevent ingestion of the pacifier by the premature infant.

12. The pacifier for a premature infant according to claim 10, wherein:

said mouth shell further includes a generally V-shaped notch defined in said flared annular surface and said perioral surface, said V-shaped notch being sized to accommodate the infant's nose and nasograstric tubes therethrough when said pacifier is in place in the premature infant's mouth and when nasogastric tubes are in place in the infant's nose; and said V-shaped notch forming a fillet in said perioral surface, wherein said fillet is arranged relative to said nipple so that said nipple cannot be fully positioned within the premature infant's mouth unless the infant's nose is through said V-shaped notch and fillet.

13. A pacifier for a premature infant, comprising:

a mouth shell having a perioral surface for contacting the perioral region of the premature infant when the pacifier is in place in the infant's mouth, said perioral surface being substantially concave to conform to the perioral region when the pacifier is in place, and said perioral surface including a plurality of flexible and resilient projections extending therefrom for contact with the perioral region of the infant; and a nipple projecting from said mouth shell.

14. The pacifier for a premature infant according to claim 13, wherein:

said plurality of projections includes a pattern of nubs arranged around the perimeter of said perioral surface.

15. The pacifier for a premature infant according to claim 12, wherein:

said mouth shell is composed of a resiliently flexible material so that when said perioral surface is contacting the perioral region of the infant, said perioral surface produces a pressure uniformly over the perioral region when the infant is sucking on the nipple.

16. The pacifier for a premature infant according to claim 15, wherein:

said pacifier is of one piece construction;

said nipple includes a first end and a tip distal said perioral surface, and further includes a cavity opening from said first end along the longitudinal length of said nipple; and said nipple is composed of a resilient material having sufficient rigidity to generate a uniform pressure against the hard palate and tongue of the infant during sucking.

* * * * *